US006155024A

United States Patent [19]

Bussey, III et al.

[11] Patent Number: 6,155,024

[45] Date of Patent: Dec. 5, 2000

[54] FILLING MACHINE FOR PARTICULATE MATERIAL

[76] Inventors: Harry Bussey, III, 517 Locust Pt. Rd., Locust, N.J. 07760; Harry Bussey, Jr., 440 Sea View Ct., Marco Island, Fla. 33937

[21] Appl. No.: 09/334,870

[22] Filed: Jun. 17, 1999

Related U.S. Application Data

[62] Division of application No. 09/047,282, Mar. 24, 1998, Pat. No. 6,035,606.

[51] Int. Cl.[7] ..... B65B 51/05

[52] U.S. Cl. ..... 53/138.4; 53/138.2

[58] Field of Search ..... 53/138.4, 139.1, 53/370.4, 370.6, 583, 138.6, 138.7, 138.8, 138.2, 138.3

[56] References Cited

U.S. PATENT DOCUMENTS

| | | | |
|---|---|---|---|
| 2,513,459 | 7/1950 | Dodge | 53/138.4 |
| 4,223,508 | 9/1980 | Wells | 53/138.4 |
| 4,352,232 | 10/1982 | Winders et al. | 53/138.4 X |
| 4,939,885 | 7/1990 | Steinke | 53/138.4 |
| 5,269,054 | 12/1993 | Poteat et al. | 53/138.4 X |

*Primary Examiner*—Linda Johnson
*Attorney, Agent, or Firm*—Francis C. Hand; Carella, Byrne, Bain, Gilfillan, Cecchi, Stewart & Olstein

[57] ABSTRACT

A filling machine employs a rotary table with a plurality of peripheral openings for receiving bags for filling with particulate matter as the table rotates. A gathering and severing unit is provided on the table in order to close the bag after filling. This unit includes a pair of guide plates which serve to gather a part of the bag when the guide plates are moved towards each other. In addition, a reciprocally mounted severing blade is positioned on one of the guide plates and is reciprocated transversely of the movement of the guide plates in order to sever the gathered part of the bag. The blade may be reciprocated twice to ensure complete severance of the gathered part of the bag.

5 Claims, 6 Drawing Sheets

25
31
35
34
33
32
32
36
37
38
40
44
43
42
30
17
28
31
29
39
47
27
46
48
51
48
45
49
50

11
18
18
17
17
23
27
27
31
45
46
48
28
42
43
44
38
32
36
37

FILLING MACHINE FOR PARTICULATE MATERIAL

This is a Division of application of Ser. No. 09/047,282 filed on Mar. 24, 1998 now U.S. Pat. No. 6,035,606.

This invention relates to a filling machine for particulate material. More particularly, this invention relates to a filling machine for packaging foamed packaging elements.

As is known, various types of filling machines have been used for filling bags with particulate materials, such as foamed plastic packaging elements. For example, filling machines have been known which employ a hopper which is filled with foamed packaging elements, a chute which extends downward from the hopper and a bagging device below the chute for positioning a bag below the chute for receiving a charge of packaging elements. Such machines serve to deliver a flow of packaging elements into the open bag in a batch-wise operation. That is to say, once one bag has been filled to a particular level or weight, the chute is closed off from the bag so that the bag can be removed, closed and transported away from the machine. A fresh empty bag can then be placed under the chute to receive a fresh supply of packaging elements.

Typically, once a bag has been filled, the bag is conveyed by various devices to a storage position where other bags of packaging elements are also stored.

From time-to-time, the stored bags are again conveyed by suitable devices to a loading dock or the like in order to be placed in a transport vehicle for transport to other points of a distribution chain.

As can be appreciated, the overall time required for filling bags with foamed packaging elements, storing the bags until ready for delivery and transporting the bags to a loading dock is time consuming and labor-intensive. Further, a relatively large storage area is required for the filled bags until such time as the bags can be delivered to a loading dock.

Accordingly, it is an object of the invention to reduce the time for filling bags with particulate materials.

It is another object of the invention to reduce the time required to fill bags with foamed packaging elements and to then load the bags onto a transport vehicle.

It is another object of the invention to reduce the amount of labor required for filling, storing and transporting bags of foamed packaging elements.

Briefly, the invention provides a filling machine which includes a conveyor, a first station for suspending a bag from the conveyor, a second station having a chute for delivering a flow of particulate material into the suspended bag and a third station having a means for closing an upper end of the particulate-filled bag while still suspended from the conveyor.

In one embodiment, the conveyor is in the form of a rotary table which is mounted for rotation about a vertical axis of rotation. In this embodiment, the various stations are spaced peripherally about the rotary table. In another embodiment, the conveyor is in the form of a rectilinear conveyor with the various stations spaced longitudinally along the conveyor.

The filling machine also has a severing means at the third station for severing a closed particulate-filled bag suspended from the conveyor after closure of the bag.

In addition, a second conveyor is disposed below the severing means in order to receive and convey a closed particulate filled bag to a transfer point, for example, directly to a loading dock for subsequent transfer by suitable means into a transfer vehicle.

In order to accommodate a bag, the conveyor is provided with an opening along with mounting means adjacent the opening for suspending a bag below the opening. In such an embodiment, the conveyor may be provided with bags on a manual basis. That is to say, during operation, an operator would manually place a bag on the mounting means on the conveyor so that the bag depends through the peripheral opening. The conveyor may then be indexed to move the bag to below a blower mounted over the conveyor at a further station in order to have a relatively low flow of air blown into the bag to expand the bag. In this respect, the blower may not be necessary to the overall operation of the filling machine where the bag can be suitably opened in order to receive a charge of particulate material at a downstream station.

Further indexing of the conveyor brings the expanded bag to a chute mounted above the conveyor at the next station. The chute may be operated on an intermittent basis in order to deliver a flow of particulate material from a supply source, such as a hopper, into the expanded bag. After a suitable charge of material has been delivered into the bag, the conveyor is again indexed to the next station so that the upper end of the particulate-filled bag can be closed. Closure of the bag may be accomplished by use of a separate closure or by use of heat. In the case of a separate closure, the means for closing the bag is in the form of a closure applying means including a pair of shaped guide plates which are mounted in facing relation to each other and means for moving the guide plates towards each other in order to gather an upper part of the particular-filled bag therebetween. In addition, the closure applying means includes a stapler mechanism for applying a staple about the gathered part of the particulate-filled bag in order to close the bag.

The severing means at this third station cooperates with the closure applying means and is employed to cut the bag at a point above the closure and below the conveyor in order to separate the filled bag from the conveyor. In this respect, the severing means includes a reciprocally mounted blade having a V-shaped notch with a cutting edge for severing the bag.

Once the bag has been severed and separated from the conveyor, the bag is allowed to descend onto the second conveyor in order to be conveyed to the transport point.

Where the means for closing the bag employs a heat seal arrangement, the means for closing the bag also includes a pair of depending pins and an actuating means for moving the pins between a first position within an upper end of a bag suspended from the conveyor and a second position with the pins spaced farther apart to deform the upper end of the bag into two facing edges. These pins are mounted on the conveyor at the opening through which the bag is suspended and are manipulated in coordination with the mounting means which suspend the bag from the conveyor. In addition, the means for closing a bag includes a heat seal device for heat sealing the facing edges of the bag together. Such a heat seal device may include a pair of retractable heat seal bars which are mounted for movement between a retracted position spaced from each other and an extended position sandwiching the facing edges of a bag therebetween.

In operation, once a bag has been filled, the depending pins are moved into the plane of the upper end of the bag and then retracted into spaced apart relation so that the bag is grasped and the mouth of the bag deformed into a widened position in which two facing edges of the bag are brought into parallel position. The heat seal device is then actuated so that the heat seal bars heat seal the two facing edges of the bag together. Once the heat seal bars are retracted, the bag may be deposited onto the conveyor below for conveyance to a transfer point or the bag may be severed by a suitable severing means at a point above the heat seal closure and below the depending pins and deposited onto the conveyor below.

If the bag is not severed above the heat seal closure line, the flaps which remain may be used as a handle in subsequent uses of the bag.

These and other objects and advantages of the invention will become more apparent from the following detailed description taken in conjunction with the accompanying drawings wherein.

Figure 1:
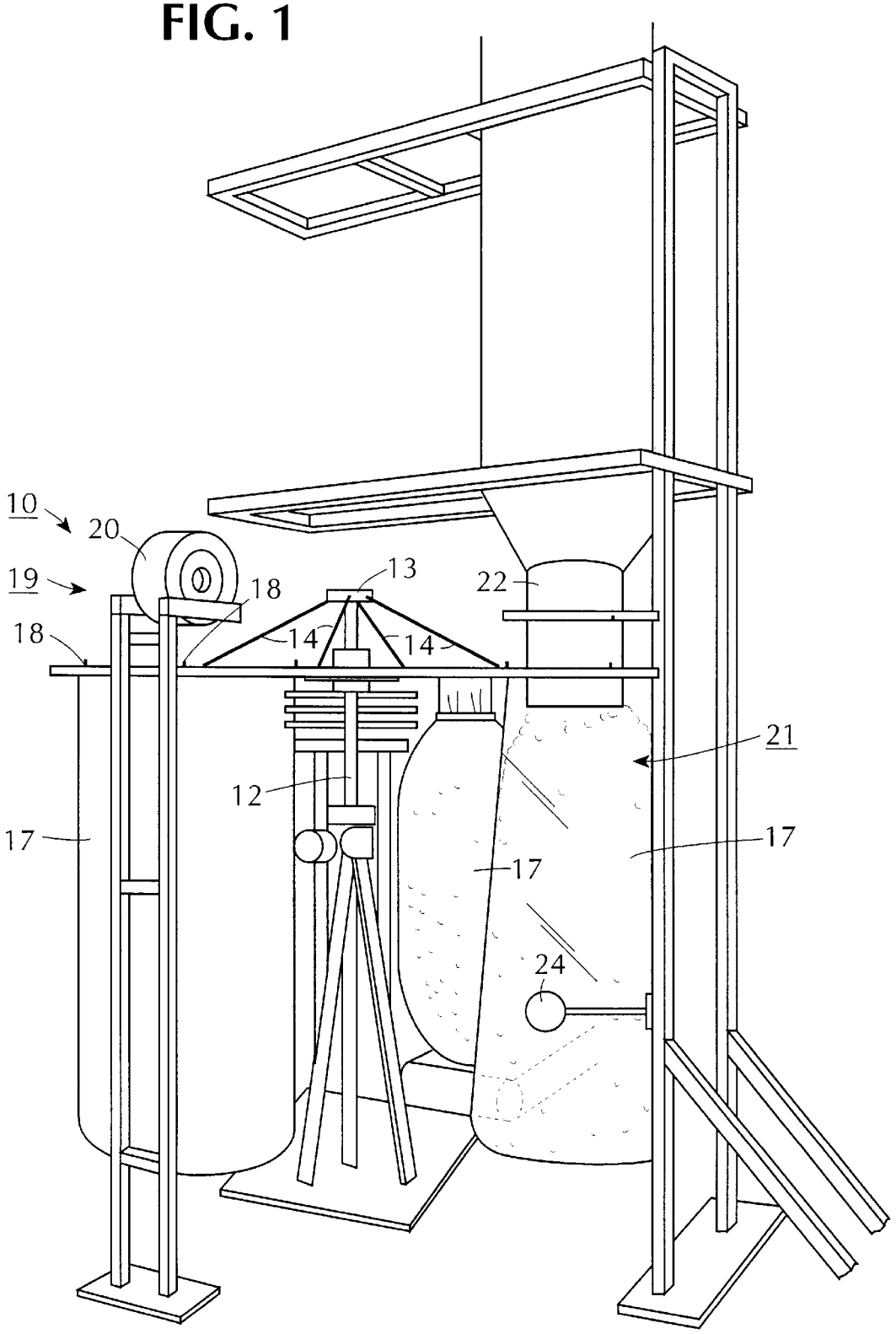
FIG. 1 illustrates a perspective view of one embodiment of a filling machine constructed in accordance with the invention and using a rotary table as a conveyor.
Figure 2:
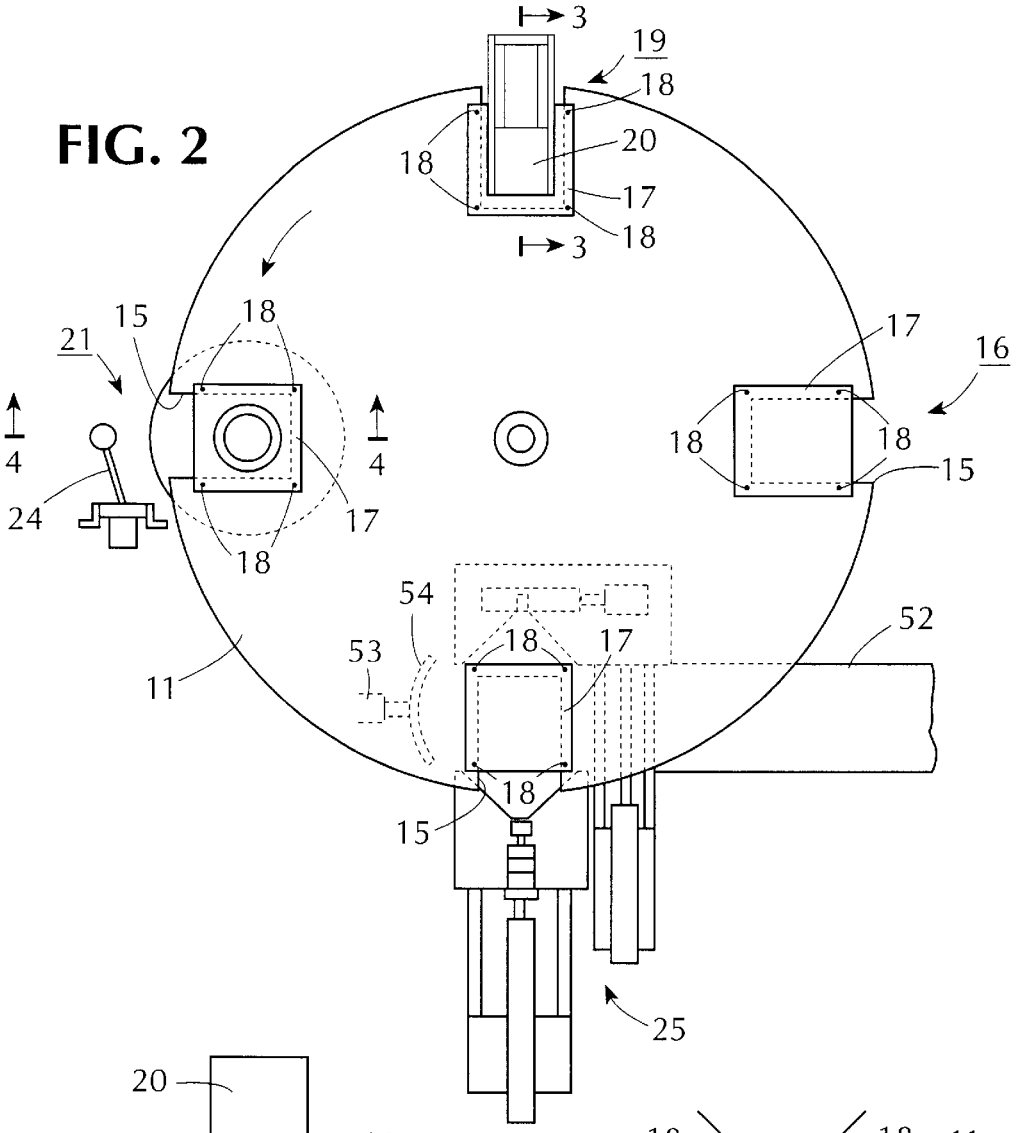
FIG. 2 illustrates a plan view of the filling machine of FIG. 1.

Referring to FIGS. 1 and 2, the filling machine 10 is constructed for filling particulate materials, such as foamed plastic packaging elements, into bags, for example having a volume of about 5 cubic feet. However, there is no limit on the size of the bag which may be filled.

In the illustrated embodiment, the filling machine 10 has a conveyor in the form of a rotary table 11 for rotation about a vertical axis of rotation. As indicated in FIG. 1, the rotary table 11 is mounted on the central shaft 12 which is driven by a suitable motor and transmission arrangement (not shown) to rotate in a clockwise direction as viewed in FIG. 2. As also shown in FIG. 1, the shaft 12 extends to a point above the rotary table 11 and has a hub 13 mounted at the upper end. A plurality of guy wires or cables 14 extend in a radial fashion from the hub 13 and are connected to the rotary table 11 to lend stability and support to the rotary table 11.

The rotary table 11 is provided with four peripherally disposed rectangular openings 15. The number of openings 15 correspond with a number of stations which are disposed peripherally about the rotary table 11 for carrying out various operations. Depending upon the number of stations, the number of openings may vary.

Referring to FIG. 2, the filling machine 10 has a first station 16 for suspending a bag from the rotary table 11. The bag mounting station 16 may employ a raised platform on which an operator may stand for manually mounting a bag 17 on the table 11. In this respect, a mounting means is provided on the table 11 adjacent each peripheral opening 15 for suspending a bag 17 below the opening. As shown, the mounting means includes a plurality of upstanding posts 18 which are fixedly secured on the rotary table 11, one at each corner of the rectangular peripheral opening 15. In this respect, the operator simply impales the opening of a bag 17 on the respective posts 18 in a spread out condition.

Typically, the rotary table 11 is indexed to move in increments between the various stations at a rate sufficient for an operator to mount a bag at the bag mounting station 15 on the table 11.

Figure 3:
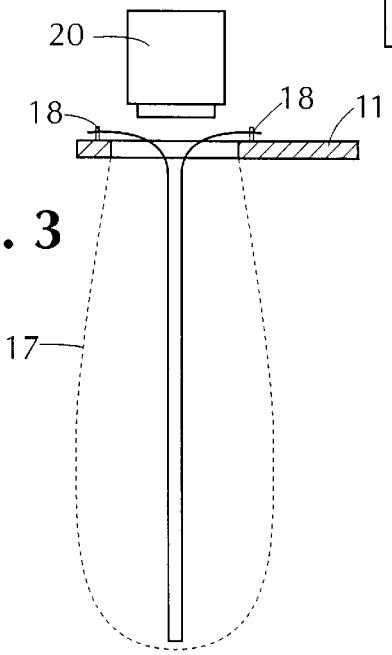
FIG. 3 illustrates a view taken on line 3—3 of FIG. 2 of a blower of the filling machine.

As shown in FIG. 2, the filling machine 10 is provided with a peripheral station 19 downstream of the bag mounting station 16. As indicated in FIGS. 2 and 3, this station 19 employs a blower 20 for blowing air into a bag 17 suspended from the table 11 in order to expand the bag 17. As indicated in FIG. 3, the bag which is used is typically a plastic bag which has sides which typically adhere to each other. By blowing air into the bag under a gentle force, the bag 17 is expanded to receive particulate material. In this respect, only a small amount of air is required in order to blow the bag 17 open. Th air which is blown in may be of an anti-static nature, such as air blown in by a Simco Antistat Blower, to eliminate static.

Figure 4:
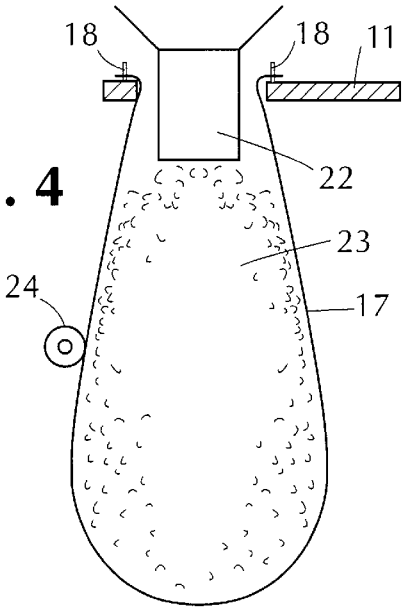
FIG. 4 illustrates a view taken on line 4—4 of FIG. 2 of a chute used for filling a bag.

The filling machine 10 includes a further station 21 at which particulate material is delivered into an expanded bag 17. As indicated in FIGS. 2 and 4, the filling station 21 employs a chute 22 for delivering a flow of particulate material, for example packaging elements 23 into the bag 17. The chute 22 is supplied with the packaging elements 23 from an overhead hopper (FIG. 1) or other suitable supply source. Typically, the chute 22 is vertically disposed and reciprocally mounted to move between a position above the rotary table 11 and a position below the table 11 and in a bag 17 suspended from the table 11. In this respect, the chute 22 is moved above the table 11 so as to not interfere with the rotation of the rotary table 11. Any suitable means may be employed for coordinating the motion of the chute 22 with the rotation of the table 11.

As illustrated in FIGS. 2 and 4, the filling station 21 is provided with a tamping device 24 for tamping the bag 17 during filling in order to break up any clumps or agglomerations of packing elements 23 within the bag 17. Any suitable type of tamping device 24 may be used for this purpose. Further, the tamping device 24 may be operated intermittently or continuously in coordination with the movements of the chute 22 and the table 11.

Figure 5:
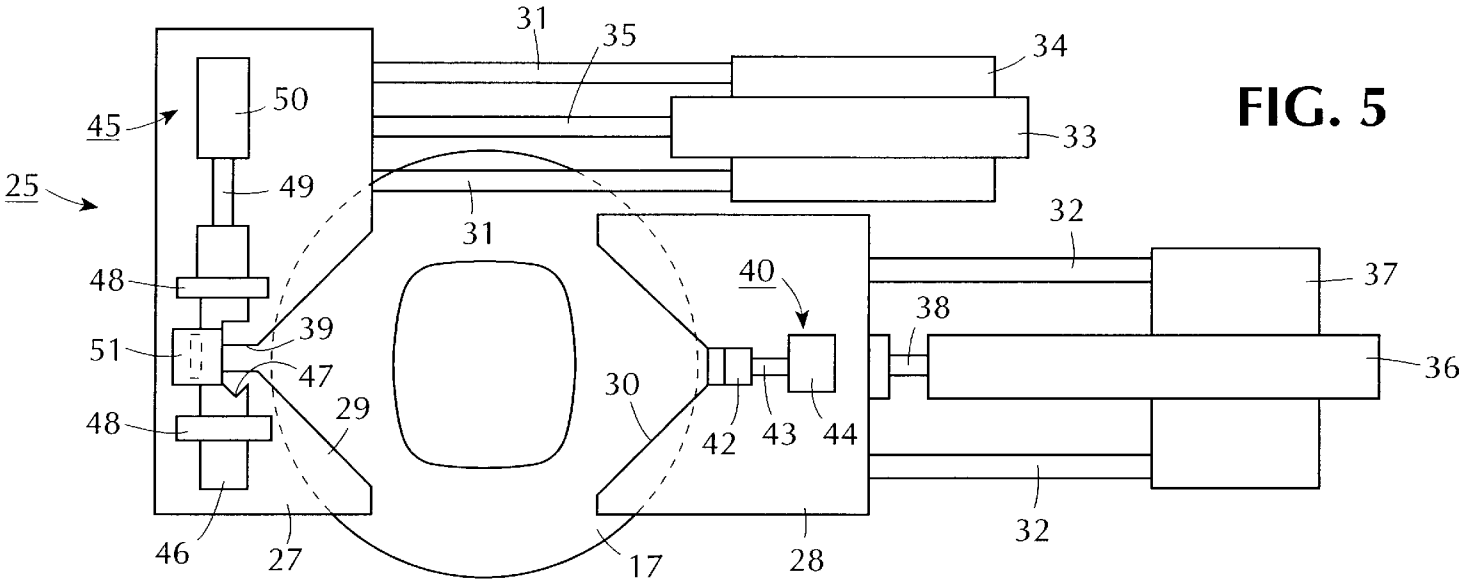
FIG. 5 illustrates a plan view of a closure applying means constructed in accordance with the invention with the rotary table removed.
Figure 6:
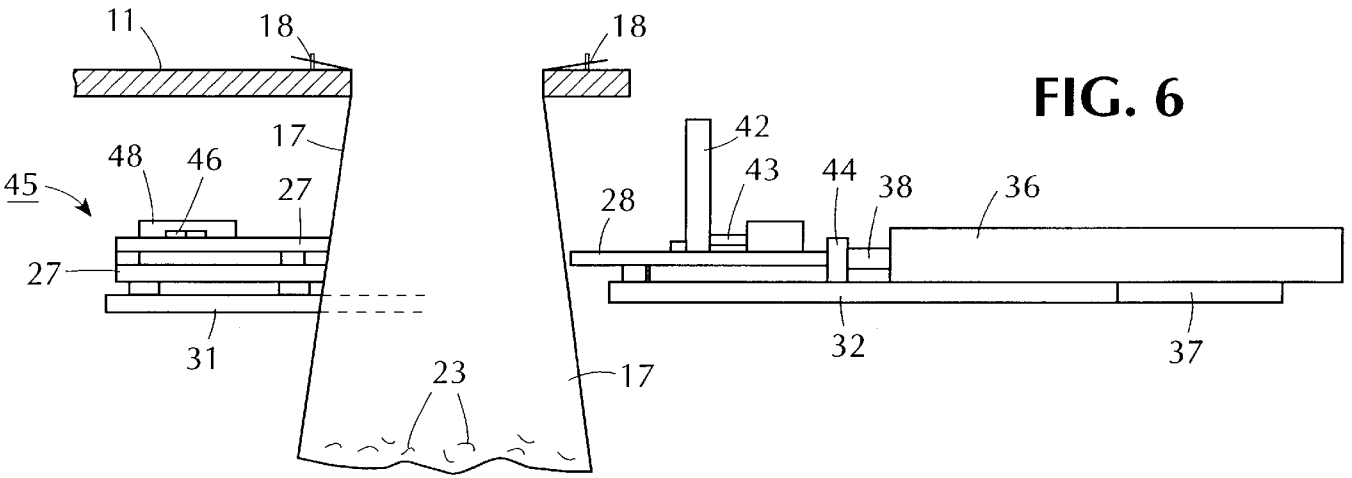
FIG. 6 illustrates a side view of the closure applying means of FIG. 5 in accordance with the invention.

Referring to FIG. 1, the filling machine has a fourth station 25 for closing of the bag 17. As indicated in FIGS. 5 and 6, this station 25 includes a closing means 26 in the form of a closure applying means for applying a closure 27, i.e. a staple (see FIG. 10), to an upper end of a particulate filled bag 17 suspended from the rotary table 11. As illustrated in FIG. 5, the closure applying means 26 employs a pair of guide plates 27, 28 which are provided with V-shaped recesses 29, 30 respectively lined with wear plates (not shown) and which are reciprocally mounted relative to each along a common axis in order to gather an upper end of a bag therebetween. In this respect, one plate 27 is slidably mounted on a pair of rails 31 to be moved towards the bag 17 while the other plate 28 is mounted on a second set of rails 32 to be moved towards the bag 17 from an opposite direction. Suitable means are provided for moving the guide plates 27, 28 towards each other. As indicated, a cylinder 33 is fixedly mounted on a frame 34 on the filling machine 10 while a piston 35 is slidably mounted within the piston 33 and attached to the guide plate 27 in order to reciprocate the guide plate 27 on the rails 31 upon actuation of the cylinder 33 in a suitable manner. A similar cylinder 36 is mounted on another frame 37 fixed to the filling machine 10 for reciprocating a piston 38 secured to the second guide plate 28 for similar purposes.

Referring to FIG. 6, a second guide plate 27' of similar shape is aligned below the guide plate 27 under the rotary table 11 to form a space to receive the guide plate 28 therebetween. This arrangement serves to ensure gathering of the upper end of the bag 17.

Figure 7:
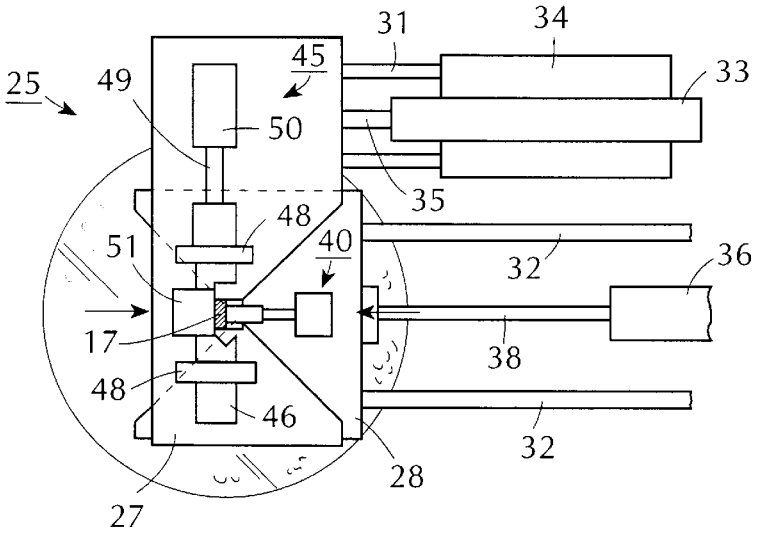
FIG. 7 illustrates a view similar to FIG. 5 with the shaped plates of the closure means in a gathering position in accordance with the invention.

Referring to FIGS. 5 and 6, after the rotary table 21 has been indexed to position the particulate filled bag 17 in the closure station 25, the guide plates 27, 27', 28 are moved from a position shown in FIG. 5 into a closed position as shown in FIG. 7. In this respect, the upper end of the bag 17 is gathered between the V-shaped recesses 29, 30 of the respective guide plates 27, 27', 28.

Figure 10:
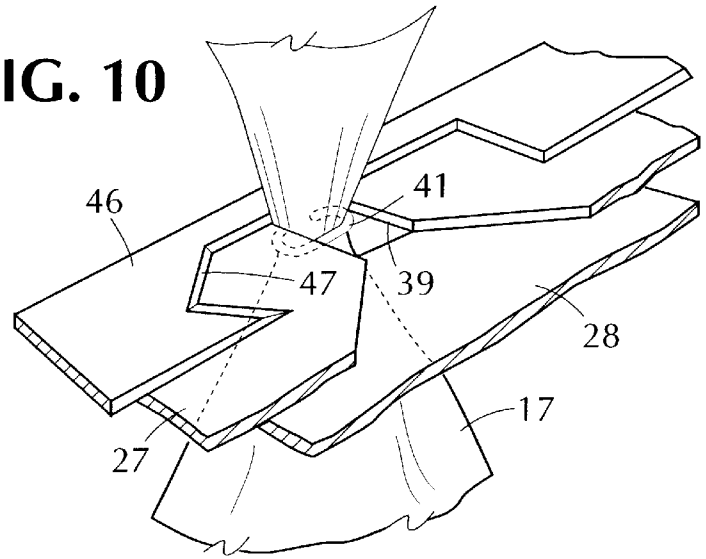
FIG. 10 illustrates a perspective view of the cutting blade immediately prior to severing of a bag in accordance with the invention.

Referring to FIGS. 5 and 10, the guide plates 27, 27' are each provided with a notch 39 of rectangular shape for purposes of forming a neck in the upper end of the bag 17 as explained below.

Referring to FIG. 5, the closure applying means 26 also includes a stapler mechanism 40 for applying a staple 41 or other suitable closure about a gathered part of the particulate filled bag 17 between the guide plates 27, 28 in order to close the bag 17. As indicated, the staple mechanism 40 is mounted on the guide plate 28 to move therewith and is of conventional construction such as a Model SC50 Bostich stapler unit.

The stapler mechanism 40 includes a vertical column 42 which receives a supply of staples (not shown) and a piston 43 which is driven by a suitable motor 44 in order to eject a staple in known fashion from the column 42 to about the gathered upper end of a bag 17.

The stapler mechanism 40 is programmed along with the other components of the filing machine 10 to operate after the guide plates 27, 28 have gathered the upper end of the bag 17.

Referring to FIGS. 5 and 6, the closure station 25 also employs a severing means 45 under the rotary table 11 for severing a staple closed bag 17 suspended from the table between the staple 41 and the table 11. As illustrated, the severing means 45 includes a blade 46 having a V-shaped notch 46 with a cutting edge 47 for severing the bag 17. The blade 46 is slidably mounted within two U-shaped blocks 48 secured on the guide plate 27 and is reciprocated along an axis perpendicular to the axis along which the plates 27, 28 moves via a means, such as a piston 49 which is mounted in a cylinder 50, such as a pneumatic cylinder. The cylinder 50 is fixedly mounted on the guide plate 27.

Figure 12:
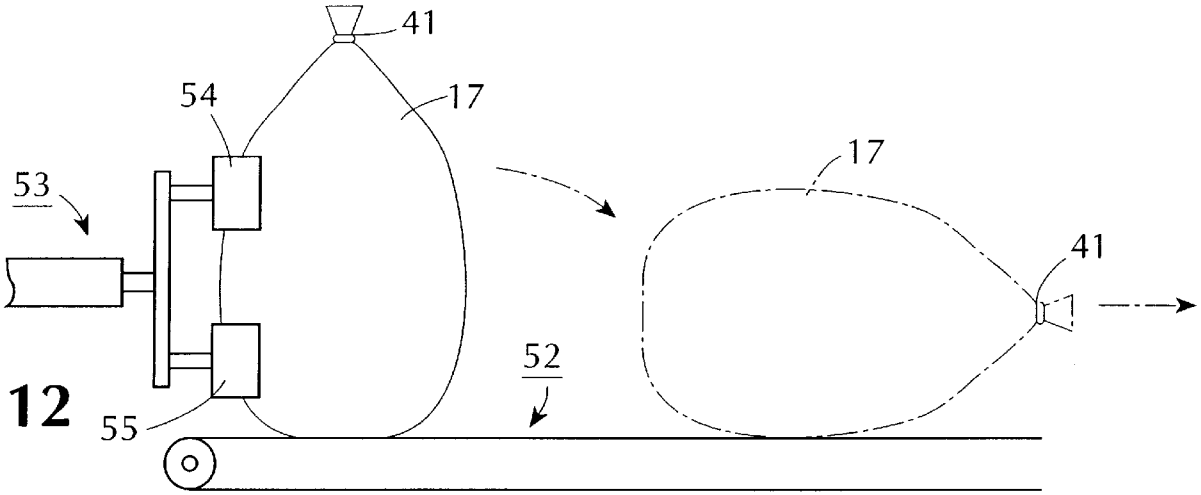
FIG. 12 illustrates a view of a transport conveyor for conveying filled bags from the filling machine in accordance with the invention.

During operation of the cylinder 50, the piston 49 and thus the cutting blade 46 are reciprocated so that the cutting edge 47 of the blade 46 is moved from an extended position as indicated in FIG. 10 in the direction indicated in FIG. 12 to a retracted position (not shown), whereby a bag 17 disposed within the notch 39 of the guide plate 27 is severed.

Referring to FIG. 5, the guide plate 27 is also provided with a back-up block 51 against which a staple 41 is deformed about the neck of the bag 17.

During operation of the filling machine 10, an operator places a bag 17 in the peripheral opening 15 of the table 11 at the bag mounting station 16. During this time, the rotary table 11 is stationary. The table 11 is then indexed to rotate the table 11, for example 90° to bring the extended bag 17 below the blower 20 at the blowing station 19. Air is then blown into the bag 17 to expand the bag from a collapsed condition as shown in FIG. 3 to an expanded condition similar to that as shown in FIG. 4.

The table 11 is then indexed a second time to move the expanded bag 17 to the filling station 21. The filling chute 22 then moves downwardly into the bag 17 and a supply of expanded packaging elements 23 are deposited, for example, by being blown into the expanded bag 17.

Figure 8:
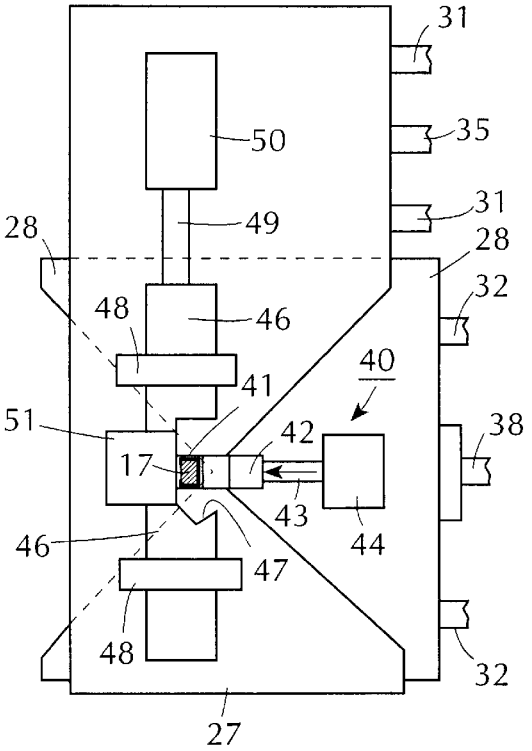
FIG. 8 illustrates a plan view of the staple mechanism applying a staple to a bag and a reciprocally mounting blade for severing the closed bag.

Next, the rotary table 11 is again indexed 90° to bring the filled bag 17 to the closure station 25. With the filled bag disposed in the closure station 25 as indicated in FIG. 6, the guide plates 27, 28 are actuated to move towards each other from the extended position shown in FIG. 5 to the closed position shown in FIG. 7. During this time, the V-shaped recesses 29, 30 of the guide plates 27, 28 gather the upper end of the bag together about the vertical axis of the bag 17. In addition, as the guide plates 27, 28 move into the overlapping position as indicated in FIGS. 7 and 8, the gathered bag is moved against the back-up block 51. Next, the staple mechanism 40 is actuated so that the staple 41 is pushed against the block 51 and closed about the gathered portion of the bag 17 as indicated in FIG. 10. The piston 43 of the staple mechanism 40 is then retracted.

Figure 9:
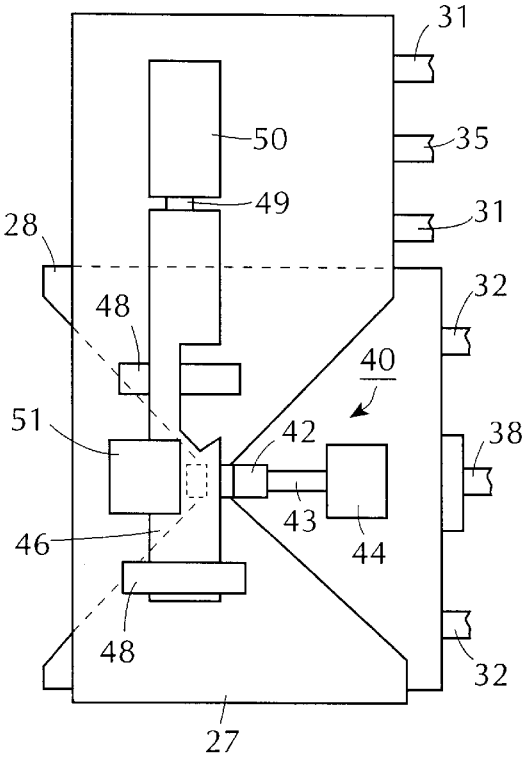
FIG. 9 illustrates a view similar to FIG. 8 showing the positioning of a bag for severing by the blade.
Figure 11:
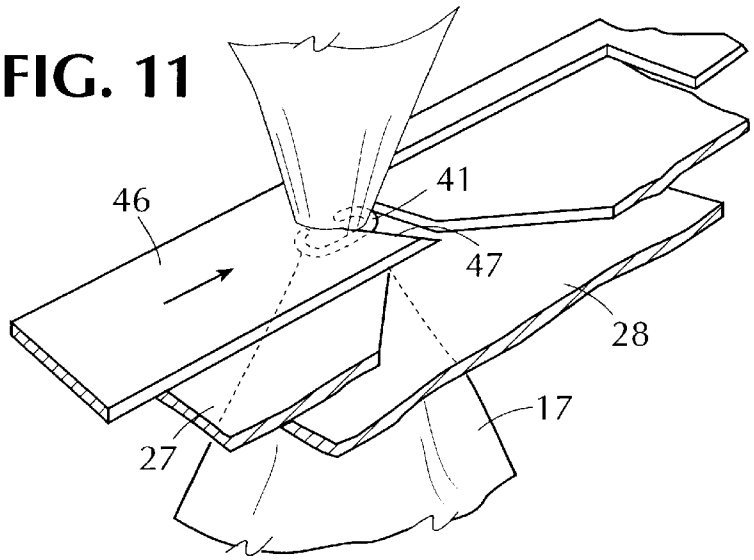
FIG. 11 illustrates a view similar to FIG. 10 of the cutting blade cutting through a bag in accordance with the invention.

Next, the severing means 45 on the guide plate 27 is actuated so that the cutting blade 46 is retracted toward the cylinder 50 as indicated in FIG. 9 to sever the bag 17 at a point above the staple 41 as indicated in FIG. 11 and below the rotary table 11. In this respect, the severing means 45 may be programmed to reciprocate the blade 46 twice to ensure complete severance of the bag 17. Thus, after the staple 41 is applied, the cutting blade 46 is moved from the position shown in FIG. 8 to the position shown in FIG. 9. That is to say, the blade 46 moves over the notch 39 in the guide plate 27 (see FIG. 10) so that the bunched and stapled part of the bag 17 can be severed. The cutting blade 46 is then moved back into the extended position shown in FIGS. 8 and 10 and again retracted to the position as shown in FIG. 11 in order to ensure severance of the bag 17 above the staple 41 and below the rotary table 11.

Referring to FIGS. 2 and 12, the filling machine 10 is also provided with a second conveyor 52 for receiving the bags 17 which have been severed from the rotary table 11. In this respect, the conveyor 52 is of an endless belt type so as to move the received bags 17 as indicated in FIG. 2 substantially tangentially of the rotary table 11. A suitable pusher 53 may also be provided to position a bag 17 on the conveyor 52 and to push the filled bag 17 along the conveyor 50. As shown, the pusher 53 is provided with a top plate 54 to push the top of the bag 17 and a bottom plate 55 to push the bottom of the bag.

Figure 13:
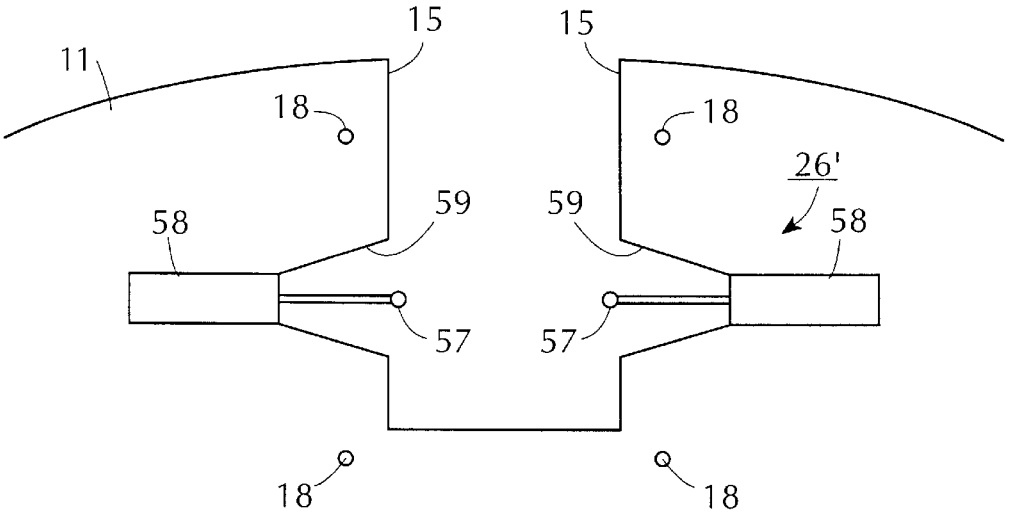
FIG. 13 illustrates a partial top view of a modified means for closing a bag in accordance with the invention.
Figure 14:
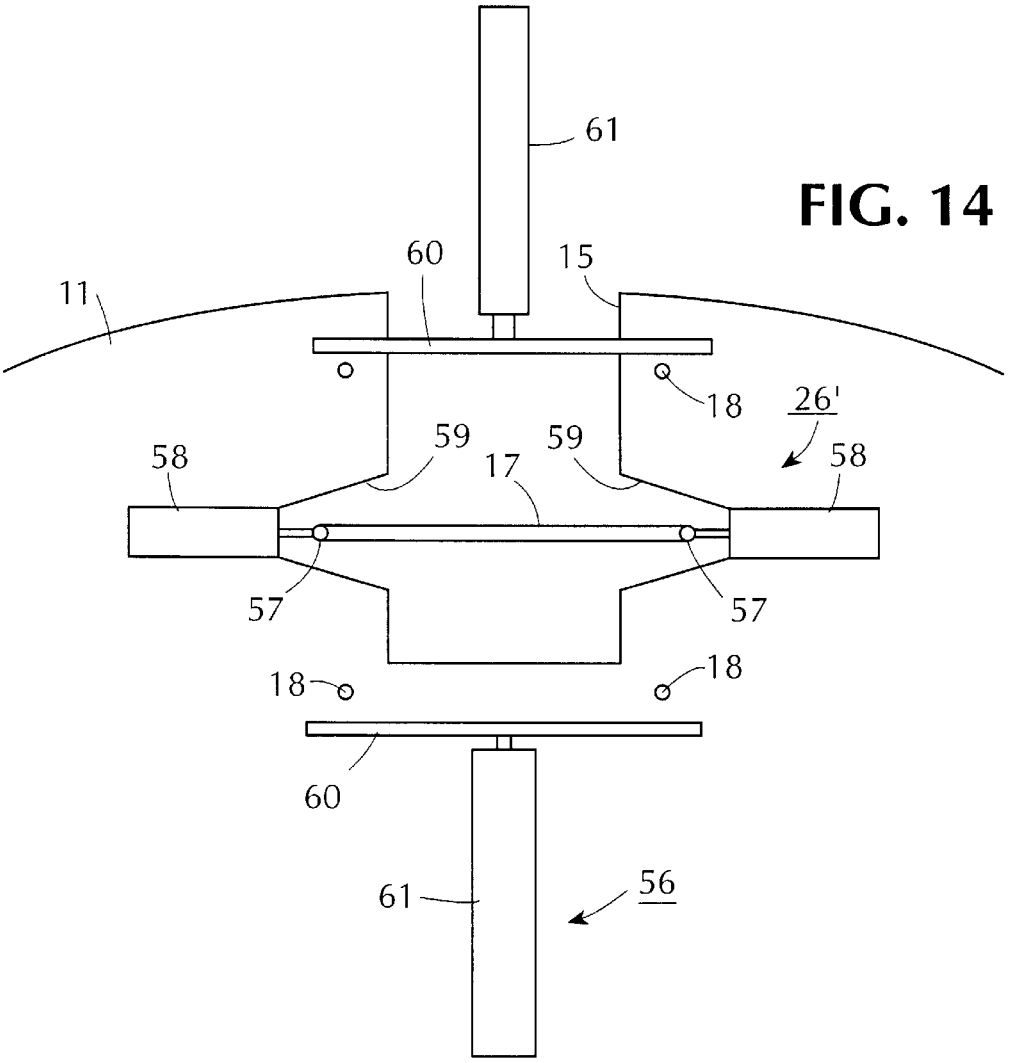
FIG. 14 illustrates a view similar to FIG. 13 of the depending pins of a closing means in an extended position relative to the heat seal bars of a heat seal device constructed in accordance with the invention.

Referring to FIGS. 13 and 14, wherein like reference characters indicate like parts as above, the filling machine may be provided with an alternative means for closing a bag than the closure applying means described above. In this respect, the means 26' for closing a bag includes a heat seal device 56 for heat sealing the open end of the bag closed.

Referring to FIG. 13, the means for closing a bag also includes a pair of depending pins 57 which are mounted above the rotary table 11. As indicated, each pin 57 is mounted on an actuating device 58 which is able to move the pin 57 from a position above the table 11 into a position in which the pin 57 depends into the mouth of a bag 17 mounted on the table 11. The actuating device 58 is also able to move the pin 57 from an extended position shown in FIG. 13 to a retracted position shown in FIG. 14.

Each pin 57 may have a straight depending portion for gripping the bag 17. Alternatively, each pin 57 may have an angled portion which is angled outwardly to effect gripping of the bag. Still further, each pin 57 may have a knurled surface for gripping of a bag 17 or may be of hooked shape for gripping of the bag.

In order to accommodate the movement of the pins 57 from the extended positions shown in FIG. 13 to the retracted positions shown in FIG. 14, each rectangular opening 15 in the table 11 is provided with a pair of opposed recesses 59 into which the respective pins 57 may be retracted.

Further, in order to accommodate the movement of the pins 57 into the extended position shown in FIG. 14, the posts 18 on the table 11 are mounted via actuating means (not shown) which serve to retract the posts 18 into and below the rotary table 11 so as to release the bag 17 therefrom.

In operation, after a bag has been filled and the rotary table 11 indexed to the next station, the pins 57 are moved downwardly into the plane of the bag 17 and then retracted in order to grasp diametrically opposite points of the bag 17 in order to begin pulling the mouth of the bag 17 into the extended position shown in FIG. 14. At the same time, the posts 18 are retracted in order to release the bag 17 therefrom. After the pins 57 have taken up the fully retracted position, the heat seal device 56 is actuated to heat seal the facing edges of the bag 17 together. As indicated in FIG. 14, the heat seal device 56 includes a pair of retractable heat seal bars 60 which are retractable via a piston and cylinder arrangement 61 in order to move between a retracted position spaced from each other as shown in FIG. 14 to an extended position sandwiching the facing edges of the bag 17 therebetween. The heat seal bars 60 are of any suitable type so as to heat seal the two facing edges of the plastic bag 17 together.

After the heat sealing operation has been performed, the pins 57 are withdrawn from the bag 17 so that the bag 17 is free to drop onto the second conveyor 52 (see FIG. 12). In the alternative, the heat seal device 56 may be used to also sever the bag 17 so that the bag 17 is dropped directly onto the second conveyor 52 while the pins 57 remain in the extended position holding the remainder of the upper end of the bag 17 as waste material.

In the event that the sealed bag is slid off the pins 57 onto the conveyor 52 below, there is no need for a severing means. In this case, the flaps of material which extend from the bag 17 above the heat seal seam may be used as handles for manual handling of the filled bags. The invention thus provides a filling machine which is capable of filling a multiplicity of bags, e.g. 240 bags per hour wherein each bag has a capacity of from 5 to 6 cubic feet of packaging elements.

Further, the invention provides a filling machine which can be mounted adjacent to a loading dock so that filled bags may be delivered directly from the filling machine into the loading dock. Further, a conveyor used for discharging filled bags from the filling machine may be extended to move into a transport vehicle at the loading dock so as to deliver filled bags directly into the vehicle.

What is claimed is:

1. In combination a closure applying means having a pair of guide plates reciprocally mounted relative to each other along a common axis, each plate having a shaped recess facing the other of said plates; means for moving said guide plates towards each other to gather an upper part of a particulate-filled bag therebetween; and a stapler mechanism for applying a staple about a gathered part of a particulate-filled bag between said guide plates to close the bag; and a severing means mounted on one of said guide plates for severing a closed bag above the staple, said severing means including a blade having a cutting edge for severing the closed bag and means for reciprocating said blade along an axis perpendicular to said common axis between an extended position with said cutting edge spaced from a gathered part of a bag and a retracted position with said cutting edge severing the gathered part of a bag.

2. The combination as set forth in claim 1 wherein said blade has a V-shaped notch with said cutting edge thereon for severing a bag gathered within said notch.

3. The combination as set forth in claim 2 wherein said one guide plate includes a recess for receiving a gathered part of a bag therein for severing by said blade, said recess being vertically aligned with said V-shaped notch of said blade with said blade in said retracted position.

4. The combination as set forth in claim 2 wherein said severing means includes a cylinder and a piston reciprocally mounted in said cylinder, said cylinder being connected to said blade for moving said blade between an extended position and a retracted position for severing of a gathered bag above an applied staple.

5. The combination as set forth in claim 1 wherein said closure applying means further includes a third plate aligned below one of said pair of guide plates to receive the other of said pair of guide plates therebetween, said third guide plate having a shaped recess for gathering a bag.

* * * * *